US005354509A

United States Patent [19]

Kuo

[11] Patent Number: 5,354,509

[45] Date of Patent: Oct. 11, 1994

[54] BASE METAL RESISTORS

[75] Inventor: Charles C. Y. Kuo, Elkhart, Ind.

[73] Assignee: CTS Corporation, Elkhart, Ind.

[21] Appl. No.: 142,783

[22] Filed: Oct. 26, 1993

[51] Int. Cl.[5] ..... H01B 1/02

[52] U.S. Cl. ..... 252/512; 420/417; 420/442; 420/452; 204/293; 252/513

[58] Field of Search ..... 420/442, 452, 417; 204/293; 252/512, 513; H01B 1/02

[56] References Cited

U.S. PATENT DOCUMENTS

Re. 24,244 12/1956 Lohr ..... 420/452
3,381,255 4/1968 Youmans ..... 252/512
3,794,518 2/1974 Howell .
4,039,997 8/1977 Huang et al. .
4,060,663 11/1977 Merz et al. .
4,225,468 9/1980 Donahue et al. .
4,298,505 11/1981 Dorfeld et al. ..... 252/512
4,639,391 1/1987 Kuo .
5,037,670 8/1991 Kuo et al. .

*Primary Examiner*—Karl Group
*Assistant Examiner*—Paul Marcantoni
*Attorney, Agent, or Firm*—Albert W. Watkins

[57] ABSTRACT

A low TCR cermet composition of pre-alloyed nickel-chromium may be blended with pre-alloyed titanium silicide to form an extended range low TCR cermet composition. Additionally, the nickel-chromium cermet composition may also be blended with a titanium silicide composition to form a blending pair that allows for unlimited resistivity control over a decade of resistance. Other low TCR base metal alloys in addition to nickel-chromium are further contemplated.

4 Claims, No Drawings

BASE METAL RESISTORS

BACKGROUND OF THE INVENTION

1. Field of the Invention

This invention pertains to electrical resistance compositions generally, and more specifically to compositions used in the manufacture of thick film cermet type resistors.

2. Description of the Related Art

Thick film resistor compositions for the purposes of this disclosure are defined as those compositions of one or more conducting materials combined with a binder. The binder may include plastics, glass compositions, ceramics, devitrifiable glasses and other materials to physically bind the conducting particles together. The binder may also assist in adhering the composition to a substrate.

In practice, the thick film material is applied to the substrate using one of a variety of well known techniques including but not limited to doctor blading, screen printing and tape transfer. Using one of these techniques, the thick film composition is applied to a substrate. Thereafter, the composition is typically heated or cured.

This disclosure pertains specifically to those thick film compositions that include a conductor component and a binder including both a transient component and a sinterable component. The transient component, sometimes referred to as a screening agent, may include such ingredients as oils, various resins, surfactants and other organic components. The binder usually includes a sinterable component.

The sinterable component may be composed entirely of a vitreous glass frit or may alternatively include ceramics and even ingredients which cause the devitrification of the glass into what is commonly referred to as a glass-ceramic. The word cermet is derived from a contraction of the words CERamic and METal.

In commercial use, these thick film compositions are usually applied to a ceramic or other heat resistant substrate, heated sufficiently to remove the transient binder materials and continued to be heated sufficiently to cause a sintering of the sinterable binder and fusion of the binder to the substrate. A high quality resistor capable of withstanding substantial temperatures and short term surges of power formed in this manner is of only moderate cost.

The need for high reliability and higher operating temperatures in a small low cost package fueled the development of these newer, more robust cermet materials. Exemplary of these materials is the ruthenium cermet materials illustrated in U.S. Pat. No. 3,304,199, assigned to the assignee of the present invention. This material, a ruthenium dioxide based material pioneered by the assignee and adopted worldwide as the industry standard yet today, offers a very high temperature material capable of surviving great extremes of power, temperature and environment.

The ruthenium cermet materials revolutionized the electronics industry and allowed applications never before possible. Unfortunately, these materials have as their primary conductive ingredients metals from the precious metal family. Most commonly used are ruthenium, silver, gold, palladium, and platinum. These materials offer several advantages over other alternatives, including the ability to be heated in air to the sintering temperature of the binder without degrading conductivity, resistance to environmental degradation, and, particularly in the case of silver, excellent conductivity.

Of course, these advantages are offset by the high cost and .limited availability of precious metals. Silver, one of the most affordable of the ingredients, is affected by moisture and can readily be induced to migrate. To reduce this migration, silver is often alloyed with palladium or platinum. However, palladium and platinum are much more expensive materials in the precious metal family. Additionally, the alloy has much worse electrical conductivity than silver alone.

There are many requirements for electrical resistors, one of which is cost. In addition, resistors are generally evaluated by their stability during and after adverse conditions such as temperature and humidity extremes, short duration power overloads (STOL—Short Term OverLoad), and even accelerated aging testing.

In addition, thick film resistor compositions will desirably have resistance values that are adjustable over wide ranges. This adjustability allows a manufacturer to stock and specify a few basic compositions, and then adjust the resistance values of the compositions for specific applications and production requirements.

The search for thick film materials offering ideal characteristics dates back about a century. As with most industries, no ideal combination of performance and price has been achieved. While the precious metal compositions pioneered by the present assignee and others have satisfied many of the performance requirements, the high cost of these materials continues to provide much impetus to developing lower cost materials of equivalent performance.

Base (non-noble) metal materials continue to find application, particularly where sufficient volumes exist to make the cost of materials a significant issue. However, existing base metal thick film cermet systems suffer several limitations. Among the limitations are available resistance ranges, blending characteristics, and processing restrictions.

Base metal resistor systems tend to be limited in resistance range where the material will still offer controlled TCR. TCR stands for Temperature Coefficient of Resistance, which is a measure of the amount of change in resistance over some temperature range. For the purposes of the remainder of this disclosure, TCR may be further divided into cold TCR (CTCR) and hot TCR (HTCR). Cold TCR is measured over the temperature range from −55 to +25 degrees Centigrade, while hot TCR is measured from +25 to +125 degrees Centigrade.

Resistivity for the purposes of this disclosure is measured in the units of ohms per square. This will be considered herein to be the resistance of a 1 mil thick film of equal length and width.

Typical tin oxide resistor systems may be formulated to offer from a few thousand ohms per square to several million ohms per square within a +−100 part per million per degree Centigrade (hereinafter ppm/°C.) TCR. An example of tin oxide systems may be found in U.S. Pat. Nos. 4,655,965, 4,698,265, 4,711,803, and 4,720,418 assigned to the assignee of the present invention.

There are base metal resistor systems which offer lower resistance ranges with low TCR values. For example, titanium silicide may be formulated to offer resistance values from a few ohms per square to a few thousand ohms per square with +−100 ppm/°C. TCR. This is illustrated in U.S. Pat. No. 4,639,391 assigned to the assignee of the present invention and incorporated herein by reference. Unfortunately, the titanium silicide formulation may not be blended together with the tin oxide formulation and still obtain low TCR values. Additionally, there are many applications requiring resistance values below 10 ohms per square. In this vein, there have been several attempts at providing low resistance base metal compositions.

U.S. Pat. No. 3,794,518 assigned to TRW illustrates the use of pre-alloyed copper nickel compositions to form thick film cermet resistors. The resistors created using these materials are very restricted in resistance range, typically in the tenths of an ohm per square range.

A similar composition using copper and nickel powders which alloy during the sintering process is illustrated in U.S. Pat. No. 5,037,670, assigned to the assignee of the present invention. Therein, copper nickel compositions are illustrated which may be varied using a number of techniques and which offer superior TCR control, but which are still limited to resistance values in the tenths of an ohm per square range.

Other base metal compositions of interest include lanthanum hexaboride, illustrated for example in U.S. Pat. No. 4,225,468 assigned to Du Pont, and also nickel chromium compositions such as illustrated in U.S. Pat. No. 4,060,663 assigned to TRW. The nickel chromium pre-alloy is disclosed therein from the examples to be limited to a restricted resistance range of from 1.8 to 23 ohms, depending upon variables such as alloy to glass frit ratios and upon firing temperatures. In practice, these ranges are much more restricted, due to inability to alter firing profiles during production, constraints on tolerance of variance in composition and contamination, and other similar issues.

While lanthanum hexaboride offers some advantage in terms of resistance range, control of the other performance characteristics is very difficult and resistance range is not complete. Further, lanthanum hexaboride is much more expensive.

What is still absent in the prior art is a wide range low TCR high performance base metal material. Much sought after are ways to come closer to achieving this ideal material.

SUMMARY OF THE INVENTION

The present invention improves upon the prior art by combining pre-alloyed low TCR base metal compositions such as nickel-chromium with titanium silicide to develop a greatly extended base metal material system. Using these combinations, the inventor has discovered that it is possible to extend the working range of low TCR base metal materials to a range extending from a few tenths of an ohm per square to a few thousand ohms per square, or more than a full decade further than previously achieved.

DESCRIPTION OF THE PREFERRED EMBODIMENT

In accord with the present invention, the conductives of primary interest are titanium silicide alloys and low TCR alloys such as nickel-chromium alloys commonly referred to as Nichromeo. The titanium silicide which is preferred is a $Ti_5Si_3$ composition. This form of titanium silicide has a low TCR and low resistance.

A nickel-chromium composition may be composed of one of a variety of low TCR nickel and chromium alloys. For the purposes of this disclosure, all percentages shall be by weight. One suitable nickel and chromium alloy is the well known 80% nickel and 20% chromium, though the preferred composition is 76% nickel, 17% chromium, 4% silicon and 3% manganese. Those familiar with the art will know that there are many other low TCR nickel-chromium alloys that might also perform satisfactorily.

To form a cermet composition, a suitable glass must be chosen. These nichrome and titanium silicide alloys are resistant to oxidation, but not impervious. During a typical and well known sintering process, a glass frit is caused to soften and bond with an alumina substrate. These bonding processes typically require elevated temperatures for significant time periods. Were this sintering process to occur in an atmospheric ambient containing sufficient oxygen, oxidation of the conductive alloys accompanied by resistance and TCR variations would occur. Therefore, sintering is typically carried out in a nitrogen or other inert or slightly reducing ambient with controlled, greatly reduced levels of oxygen or oxygen bearing compounds.

As is also known in the art, nitrogen firing is most advantageous when combined with glass formulations designed to withstand the high temperature nitrogen environment. While these glass formulations are important to the correct performance of the invention, those skilled in the art will be able to compose or acquire suitable glass frit binder materials that are nitrogen firable and that have an appropriate set of properties for the intended application. Such materials are typically of the borosilicate glass frit variety, and may further include barium, bismuth, and alkaline earth elements. The use of lead and cadmium is in recent times being reduced to protect worker safety, though these materials may also have satisfactory performance. Binders which do not adversely interact with the conductor alloys, do not reduce or otherwise prove defective during sintering, and which provide satisfactory adhesion to the intended substrate, whether the substrate be alumina or some other material, are within the scope of the invention. Glass-ceramics and other materials may be most suited for this application. Examples of suitable glass frit may be found in the prior art referenced herein and elsewhere.

In the preferred embodiment, the glass frit binder and alloy conductor are blended to form a screen printable composition. Screen printing requires a paste like consistency which is generally obtained through the use of organic and often polymeric materials referred to as screening agents. These screening agents provide an appropriate consistency and rheology to the mixture to allow the paste to be forced through the screen by a squeegee without clogging the screen and also without dripping or running therethrough. Once again, the firing conditions dictate the choice of screening agents, though these vehicles are also well known.

In the preferred embodiment, a nickel and chromium alloy is blended with the appropriate binders and screening agents to form a nickel-chromium screen printable composition. Separately, a titanium silicide alloy composed primarily of $Ti_5Si_3$ is blended with appropriate binders and screening agents to form a titanium silicide screen printable composition. The two compositions may be blended together in any proportion to adjust the resistivity of the sintered thick film. These two screen printable compositions may be formulated from the same glass frit and screening agent constituent compositions, thereby ensuring complete compatibility between the two paste compositions. While this is not essential, the only variant needed is the conductive constituent. Limiting variants simplifies formulation. No adverse reaction results between these two conductive constituents, providing for a fully blendable paint formulation which can yield a wide and continuously variable resistance range.

EXAMPLE I

Commercially available pre-alloyed nickel-chromium powder was purchased and ball milled until the powder had an average particle size of five to ten microns. The conductive powder was then blended together with an alkaline earth borosilicate glass in a weight ratio of 80:20 and appropriate organic screening agents were then added to form a screening paste. The composition was then screen printed upon an alumina substrate and fired in a nitrogen atmosphere on a belt kiln at a peak temperature of 900 degrees Centigrade. The furnace profile was set to maintain the peak temperature for about ten minutes, with an appropriate slope up and down to adequately volatilize the organic constituents, sinter the inorganic binder, and cool the parts without thermal shock.

The resulting film, which was within twenty percent of one mil in thickness was measured to have a resistance of approximately 1.25 ohms/square. No compensation was made for fired film thickness, so one familiar with the art will understand that these resistance calculations are only approximate, within the tolerance of the fired film thickness. The resulting CTCR and HTCR were measured to be between 0 and +51 ppm/°C.

EXAMPLE II

A commercial $Ti_5Si_3$ alloy was blended together with binders and screening agents similar to example I above, with the exception that the titanium silicide was in a seventy-thirty relationship by weight to the glass binder. The titanium silicide was roller milled to a particle size similar to the nickel-chromium alloy of example I. After screen printing and firing as in example I, the composition had a resistance of approximately 11 ohms/square. The HTCR and CTCR were within 50 ppm/°C.

EXAMPLE III

Two parts by weight of the composition of example I were blended together with one part by weight of the composition of example II. The resulting composition was then screen printed and fired similarly to examples I and II, yielding a composition with resistivity of approximately four ohms/square and having a CTCR and HTCR within 50 ppm/°C.

EXAMPLE IV

Two parts by weight of the composition of example II were blended together with one part by weight of the composition of example I. The resulting composition was then screen printed and fired similarly to examples I–III, yielding a composition with resistivity of approximately two ohms/square and having a CTCR and HTCR within 25 ppm/°C.

These examples demonstrate a titanium silicide composition which is fully blendable with a nickel-chromium composition to yield a continuously variable resistance range between approximately one and ten ohms per square. By using these two end members to cover this decade of resistance values, a manufacturer need only maintain inventory for the two compositions and blend these compositions at the time of manufacture to suit the needs for any particular product.

In addition to these two compositions of examples I and II, there are a number of other compositions which will perform satisfactorily. While not all of these compositions will offer the added advantage of decade value blending similar to that illustrated in examples I–IV, these do offer other benefit, which upon certain occasion will be desired.

EXAMPLE V

Commercially available pre-alloyed nickel-chromium powder was purchased and ball milled until the powder had an average particle size of five to ten microns. The conductive powder was then blended together with an alkaline earth borosilicate glass of composition slightly different from that of examples I–IV in a weight ratio of 70:30. Mixed with the nickel-chromium alloy and glass frit was one percent by weight $Ti_5Si_3$. Appropriate organic screening agents were then added to form a screening paste. The resulting composition was screen printed upon an alumina substrate and fired in a nitrogen atmosphere on a belt kiln at a peak temperature of 900 degrees Centigrade, as in the other examples.

The resulting film, which was within twenty percent of one mil in thickness was measured to have a resistance of approximately 1.5 ohms/square. As with the other examples, no compensation was made for fired film thickness, so one familiar with the art will understand that these resistance calculations are only approximate, within the tolerance of the fired film thickness. The resulting CTCR and HTCR were measured to be between 0 and +105 ppm/°C.

EXAMPLES VI–VII

The composition of example V was prepared, with the exception that three and seven percent $Ti_5Si_3$ powder was used. The two resulting compositions were then screen printed and fired as in the previous examples to yield film resistivities of two and three ohms/square, respectively. The CTCR and HTCR values were all within +−100 ppm/°C.

EXAMPLES VIII–XI

Two compositions were prepared similar to example V, with ratios of Nickel-Chromium alloy to glass being 60:40. An additional two compositions were prepared with weight ratios of 50:50. To these compositions three and seven weight percent $Ti_5Si_3$ were added, yielding a total of four different compositions. All of these compositions had resulting hot and cold TCR's within +−107 ppm/°C. The resulting resistivities were two and one-half, four, three and five ohms per square, respectively.

EXAMPLE XII

An additional composition was prepared similar to example V, with ratios of nickel-chromium alloy to glass being 30: 70. Three percent $Ti_5Si_3$ was added, and the composition screened and fired as in the previous examples. The resulting CTCR was 69 and the resulting HTCR was 74. The resistivity was approximately 10 ohms/square.

COMPARATIVE EXAMPLE XIII

A composition similar to example XII was prepared, but to which was added only one percent by weight $Ti_5Si_3$. In this case, the resistivity was seven ohms per square, but the hot and cold TCR values were greater than 350 ppm/°C.

COMPARATIVE EXAMPLE XIV

A composition similar to example V was prepared, but to which was added 11 percent by weight $Ti_5Si_3$. In this case, the resistivity was five ohms per square, but the hot and cold TCR values were more than +−200 ppm/°C.

These examples illustrate the fact that, while within certain ranges as exemplified herein, $Ti_5Si_3$ may be blended with nickel chromium alloys, there is not an unlimited amount of blending to obtain the highly desirable TCR deviation of less than 200 ppm/°C., or even smaller TCR deviations which are often specified.

All of the illustrated examples exhibit very good thermal stability and offer excellent STOL performance.

While the foregoing details what is felt to be the preferred embodiment of the invention, no material limitations to the scope of the claimed invention is intended. For example, while substantial invention and discovery occurred with the evaluation of nickel-chromium alloys, other low TCR alloys are further contemplated and believed to be within the scope of this disclosure. Examples of such low TCR alloys that are contemplated for use would be those of copper and nickel, iron-chromium-aluminum, and copper-manganese.

Further, features and design alternatives that would be obvious to one of ordinary skill in the art are considered to be incorporated herein. For example, the use of titanium disilicide to increase the resistivity of the titanium silicide composition is known and illustrated in applicant's U.S. Pat. No. 4,639,391 incorporated herein. TCR drivers may be incorporated as desired. The present invention, as illustrated in example XII, has very close matching of CTCR and HTCR. This allows for the ready addition of TCR drivers when needed to perform fine adjustments and can lead to extremely precise, essentially zero TCR compositions. The scope of the invention is set forth and particularly described in the claims hereinbelow.

I claim:

1. A base metal resistor composition having a low TCR (Temperature Coefficient of Resistance), said low TCR defined as having both CTCR (Cold Temperature Coefficient of Resistance) and HTCR (Hot Temperature Coefficient of Resistance) less than 200 parts per million per degree Centigrade, comprising:

a first alloy comprising nickel and chromium, said first alloy having said low TCR;

a second alloy of titanium and silicon; and a non-volatile binder.

2. The base metal resistor of claim 1 wherein said first alloy comprises 76% by weight nickel, 17% by weight chromium, 4% by weight silicon and 3% by weight manganese.

3. The base metal resistor of claim 1 wherein said second alloy comprises $Ti_5Si_3$.

4. The base metal resistor composition of claim 1 wherein said non-volatile binder comprises a nitrogen firable glass composition.

* * * * *